US005692892A

United States Patent [19]

Houston

[11] Patent Number: 5,692,892

[45] Date of Patent: Dec. 2, 1997

[54] CONTINUOUS FLOW ROTARY VALVE FOR REGENERATIVE FUME INCINERATORS

[76] Inventor: Reagan Houston, 252 Foxhunt La., Hendersonville, N.C. 28791

[21] Appl. No.: 662,003

[22] Filed: Jun. 12, 1996

[51] Int. Cl.[6] ..... F27D 17/00

[52] U.S. Cl. ..... 432/181; 432/180

[58] Field of Search ..... 432/179, 180, 432/181, 182; 137/311

[56] References Cited

U.S. PATENT DOCUMENTS

| | | | |
|---|---|---|---|
| 4,280,416 | 7/1981 | Edgerton | 110/254 |
| 5,375,622 | 12/1994 | Houston | 137/240 |
| 5,503,551 | 4/1996 | Houston | 432/181 |

*Primary Examiner*—Henry A. Bennett
*Assistant Examiner*—Gregory Wilson
*Attorney, Agent, or Firm*—Charles L. Schwab

[57] ABSTRACT

A continuous flow rotary valve for multiple bed regenerative fume incinerators which has a cylindrical valve housing with three or more bed ports spaced equally about the middle or central portion of the housing, feed and exit ports at opposite ends of the housing and a purge port spaced from the other ports. The valve also includes a cylindrical valve rotor having feed, exit and purge cavities in free flow fluid communication with the feed, exit and purge ports. The feed and exit cavities have radially outward openings which are circumferentially wider than the circumferential space on the housing between two bed ports. During rotary movement of the valve rotor from one operating position to another, the feed cavity will supply feed gas to two bed ports during a portion of the rotary movement and the exit cavity will receive exit gas from two beds during a different portion of the rotary movement. The flow of feed gas to the incinerator and the flow of cleaned exit gas from the incinerator is uninterrupted during movement of the valve rotor to cycle the beds. The circumferential space on the exterior cylindrical surface of the rotor between the feed cavity opening and the exit cavity opening is greater than the circumferential width of the widest bed port, thus preventing leakage of feed gas to the exit cavity by way of a bed port during rotation of the valve rotor from one operating position to another. Although the valve is particularly useful in 3 bed regenerative fume incinerators, constant flow valves are also shown for 5 and 10 bed incinerators.

16 Claims, 9 Drawing Sheets

CONTINUOUS FLOW ROTARY VALVE FOR REGENERATIVE FUME INCINERATORS

TECHNICAL FIELD

This invention relates to a rotary valve for fume incinerators having at least three regenerative beds and particularly to a rotary valve providing continuous flow of feed gas to and clean exit gas from the beds during movement of the valve to change flow direction through the beds.

BACKGROUND OF THE INVENTION AND INFORMATION DISCLOSURE STATEMENT

In present commercial practice 3 bed regenerative fume incinerators are used which have 6 large 2-way valves and 3 smaller purge valves to control the flow of impure feed gas to the beds, purified gas exiting the beds and pure gas for purging. These large valves are power operated to change the flow pattern through the beds every minute or so. In my U.S. Pat. No. 5,375,622 "Multiport Valve including Leakage Control System Particularly for a Thermal Regenerative Fume Incinerator" and in my U.S. Pat. No. 5,503,551, "Rotary Valve for Fume Incinerator", the 9 valves are replaced by one rotary valve; but in operating the single valves of these two patents, the flow is interrupted for a moment while the valve rotor is being repositioned. Incinerators with 5 or 7 beds, and having 15 and 21 valves, respectively, are also being used commercially at present. Such valves are large and must be power operated. These incinerators treat very large quantities of contaminated gas and the conduits range in size up to 60 inches in diameter and larger. Obviously, such valves are very expensive. Also the flow is momentarily interrupted when repositioning the valve rotors. Momentary interruption of flow not only reduces the through flow of the system but also sends detrimental pressure waves through the equipment. A flat disc shaped valve is used to control feed, exit and purge gas flow in U.S. Pat. No. 4,280,416 issued Jul. 28, 1981 for "Rotary Valve for a Regenerative Thermal Reactor". This valve configuration has not been found practical for large present day regenerative fume incinerators.

OBJECTS AND SUMMARY OF THE INVENTION

It is a primary object of this invention to provide a rotary valve suitable for use in regenerative fume incinerators which does not interrupt the flow to and from the refractory filled beds during repositioning of the valve rotor. It is a further object of this invention to provide a rotary valve for controlling the flow through three or more regenerative beds of a fume incinerator which not only does not interrupt flow while the valve rotor is repositioned to change the flow through the installation but also substantially eliminates leakage of contaminated gases in all positions of the rotor and during rotation of the rotor between operating positions.

The single rotary valve of this invention replaces the 9, 15 and 21 valves heretofore used in 3, 5 and 7 bed incinerators. Also the valve of this invention is advantageously used in place of the valves disclosed in my U.S. Pat. Nos. 5,375,622 and 5,503,551. The gas flows are not interrupted at any time, including the time interval the rotor is being repositioned. This is achieved by providing a feed cavity in the valve rotor which bridges two bed ports during rotation of the valve rotor between predetermined operating positions and by providing an exit cavity which bridges two bed ports during rotation of the valve rotor between such predetermined positions of adjustment. The circumferential distance between the feed and exit cavities of the valve rotor is slightly greater than the circumferential width of the bed ports, thus preventing flow from the feed cavity to the exit cavity via a bed port. Leakage of impure feed gas into purified gas is prevented while the rotor is stationary and almost eliminated during the short period when the rotor is being rotated.

BRIEF DESCRIPTION OF THE DRAWINGS

Several embodiments of the invention are shown in the drawings, in which.

DETAILED DESCRIPTION OF THE DRAWINGS

Figure 1:
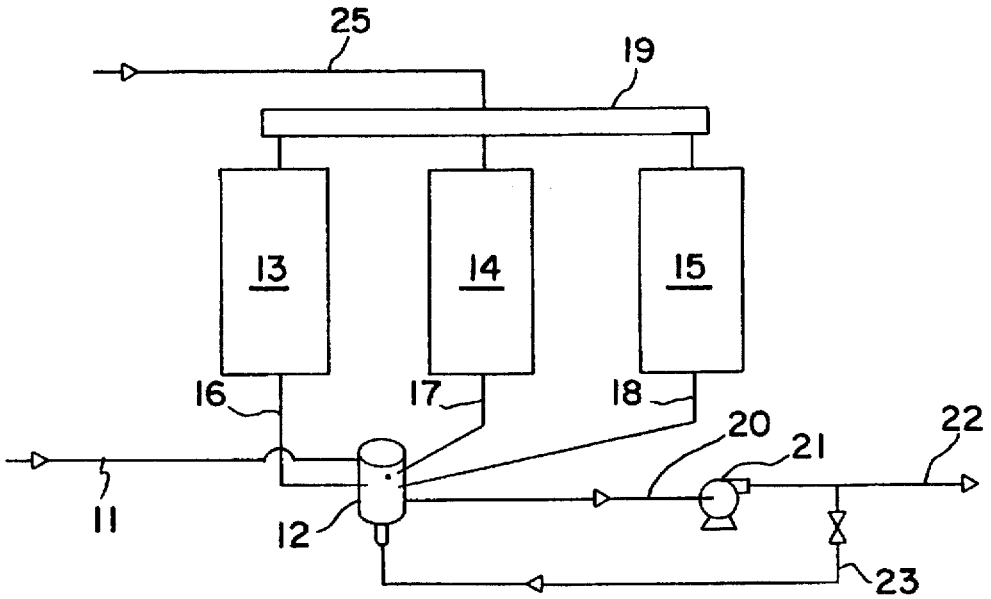
FIG. 1 is a flow diagram of a 3 bed regenerative fume incinerator system.

Referring to FIG. 1, incoming contaminated feed gas flows through a feed line 11 to a rotary valve 12, which directs the feed gas to a selected one of the refractory filled regenerative beds 13, 14, 15 by way of one of the bed conduits 16, 17, 18. From the selected bed of the 3 bed regenerative fume incinerator, the feed gas flows to a combustion chamber 19, where volatile organic compounds are oxidized to CO2 and H20. Fuel may be supplied to the combustion chamber 19 by a fuel line 25. The rotary valve also connects a second bed to an exit line 20. An exhaust blower 21 is installed in the exit line 20 so as to exhaust purified or clean gas via a blower vent or discharge segment 22 of the exit line 20. Heat from the purified gas is absorbed by the refractory in the second bed. Some of the purified gas from the blower vent 22 is returned to the rotary valve 12 by way of a purge line 23 interconnecting the blower vent 22 and the rotary valve 12 and is directed by the valve 12 to a third bed to flush impurities into the combustion chamber 19. Purging the third bed prevents feed gas impurities from being exhausted when the third bed is next used as an exit bed. By predetermined rotation of the valve 12 at timed intervals, the beds 13, 14, 15 are cyclically and sequentially connected to the impure feed gas line 11, to the purge line 23 and to the exit line 20. In an alternative arrangement, the third bed may be purged by exhausting clean gas through it and routing the purge flow to the feed gas line 11. In such an arrangement, the purge line 23 would be connected to the feed line 11 rather than the blower vent 22 and a blower would be placed in the purge line to force the purge gas into the feed line 11. The purge gas rate of flow is a minor fraction of the exit gas flow. In this alternative arrangement a main blower may be placed in the feed gas line 11 and the exit blower may be eliminated. Thus in this alternative arrangement the purge gas pressure at the rotor is less than the feed gas pressure.

Figure 2:
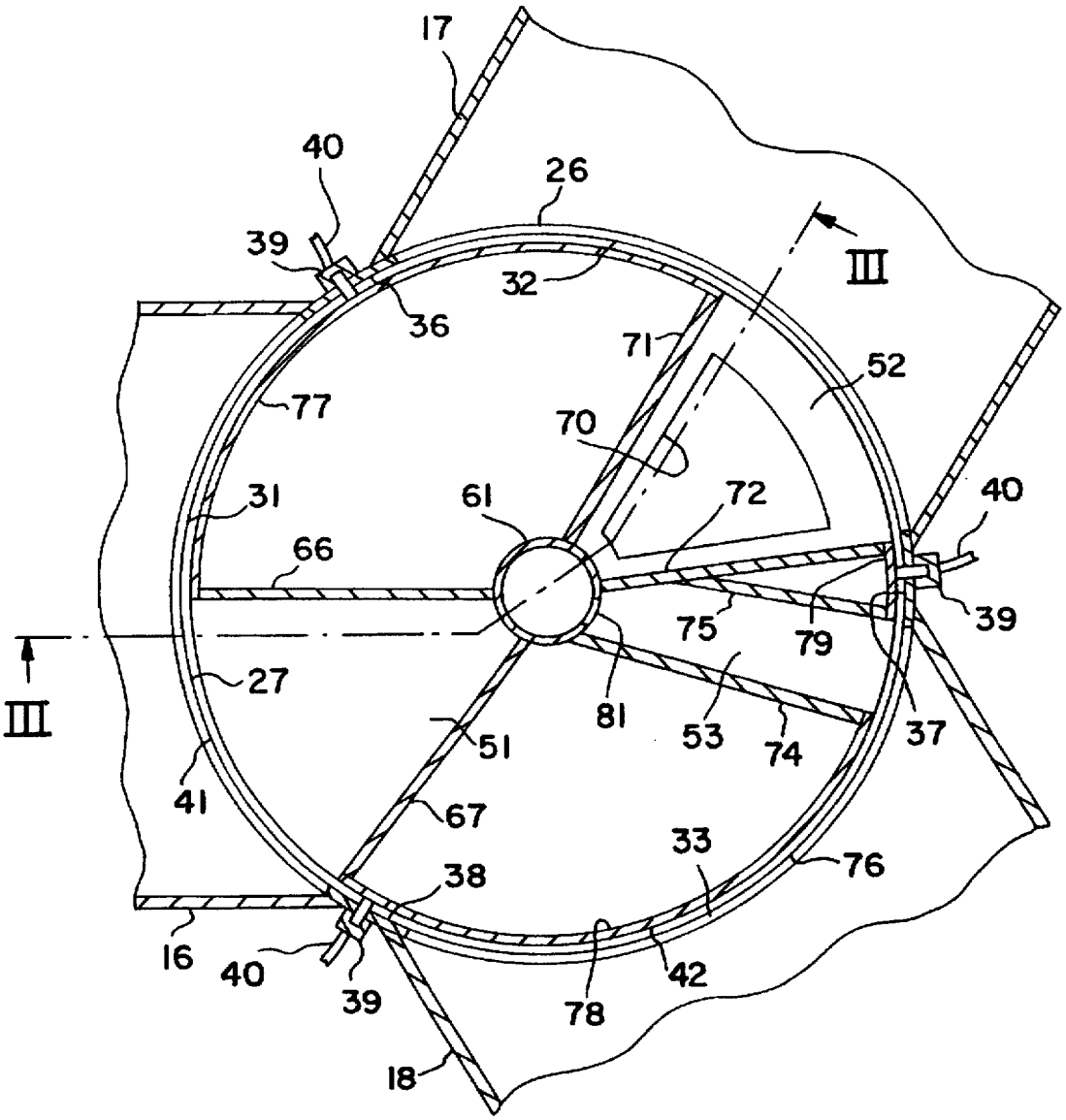
FIG. 2 is a section of a rotary valve of this invention for a 3 bed incinerator system taken along the line II—II in FIG. 3.
Figure 10:
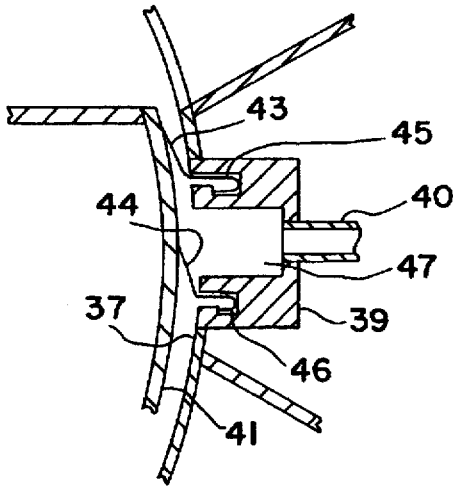
FIG. 10 is a section view of a seal between the valve housing and the valve rotor.
Figure 11:
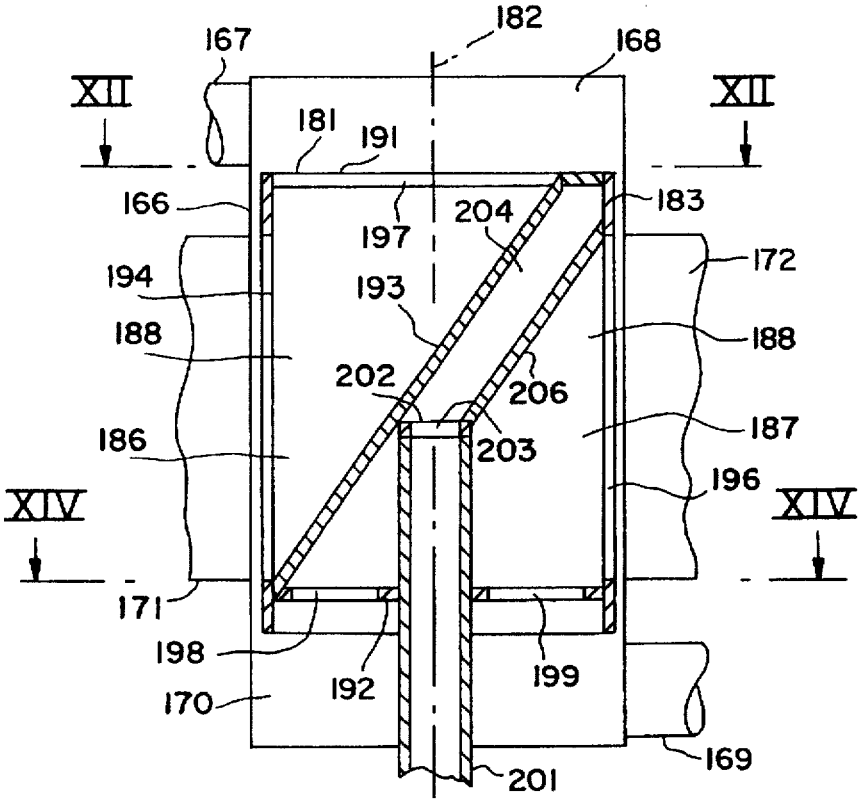
FIG. 11 is a section taken along the line XI—XI in FIG. 12 showing features of another embodiment of the invention.
Figure 12:
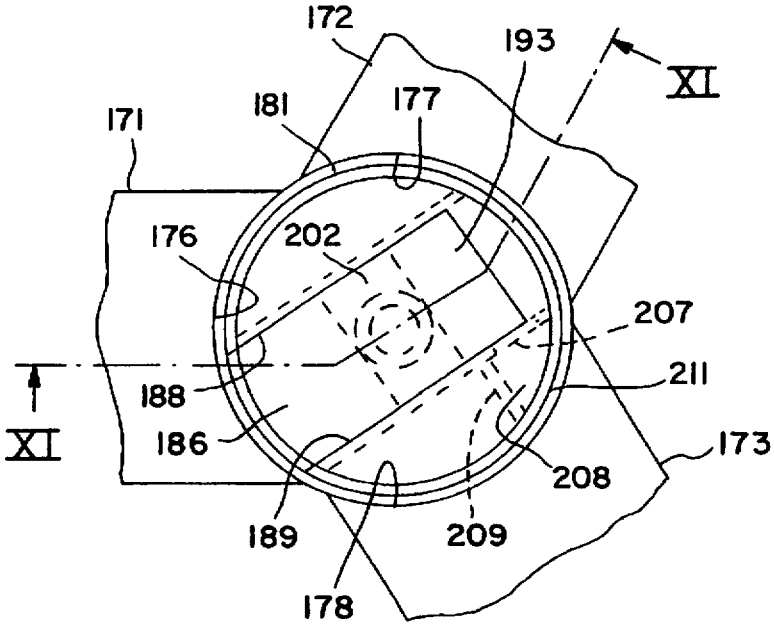
FIG. 12 is a section taken along the line XII—XII in FIG. 11.
Figure 13:
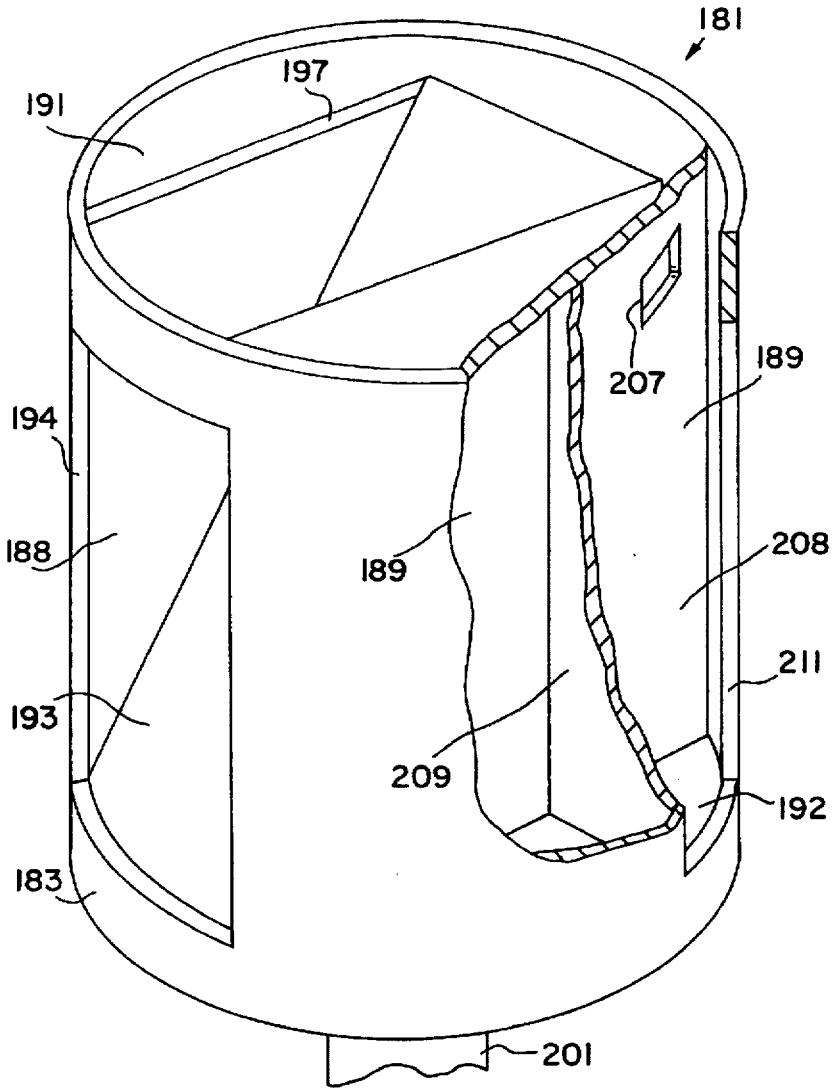
FIG. 13 is an isometric view of the valve rotor of FIGS. 11 and 12.
Figure 14:
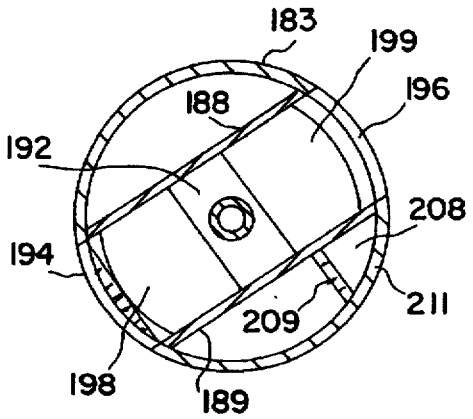
FIG. 14 is a section taken along the line XIV—XIV in FIG. 11.

Referring to FIG. 2, the rotary valve 12 includes a cylindrically shaped valve housing 26 having an interior chamber with an interior surface 27 defined by rotation of a line about the axis 28 of the valve 12. Three equal size bed ports 31, 32, 33 are formed in the central or mid-portion of the valve housing at equally spaced circumferential intervals about the annular or cylindrical surface 27 and these bed ports 31, 32, 33 are connected to the bed conduits 16, 17, 18, which in turn are connected to the cold bottom ends of the beds 13, 14, 15. The bed ports 31, 32, 33 are preferably rectangular in shape and the bed conduits may be round or rectangular. Circumferentially narrow sealing lands 36, 37, 38 are provided on the interior surface 27 of the valve housing between the bed ports 31, 32, 33. Each of the bed ports has a circumferential width of 100 to 119 degrees and the three equal width sealing lands each have a circumferential width of 1 to 20 degrees. Preferably, each of the sealing lands occupies about 5 degrees of the interior circumference of the valve housing. The rotary valve 12 includes a cylindrically shaped valve rotor 41 which has a radially outward facing cylindrical surface 42 in confronting relation to the interior cylindrical surface 27 of the valve housing 26. The 3 sealing lands 36, 37.38 are in close sealing relation to the cylindrical surface 42 of the valve rotor 41 when the rotor is at rest. A seal structure 39 is installed in each of the sealing lands 36, 37, 38, and each of the seal structures has a minor purge gas connection by way of a line 40 to a suitable source of purge gas, such as the clean gas discharge vent 22. The seal structures 39 are constructed to minimize the minor purge gas flow. As shown in FIG. 10, a pair of flexible wiper blades 43, 44 are mounted in recesses 45, 46 in the seal structure 39 and a chamber 47 between the wiper blades 43, 44 is connected to the purge gas line or conduit 40. Preferably, the purge gas is at a higher pressure than the feed and exit gases flowing through the valve, thus preventing contamination of the clean exit gas. It is also possible to prevent contaminating gas flow across the sealed area by withdrawing gas from the seal. In such an arrangement the seal purge line would be connected to the feed line and a blower would be installed in the seal purge line to force the purge gas withdrawn from the seal into the feed line. However, if the regenerator bed purging is achieved by withdrawing exit gas through the purged bed and delivering the purge gas to the feed gas line by use of a purge blower, then it would only be necessary to connect the seal purge line to the downstream side of the purge blower.

Figure 3:
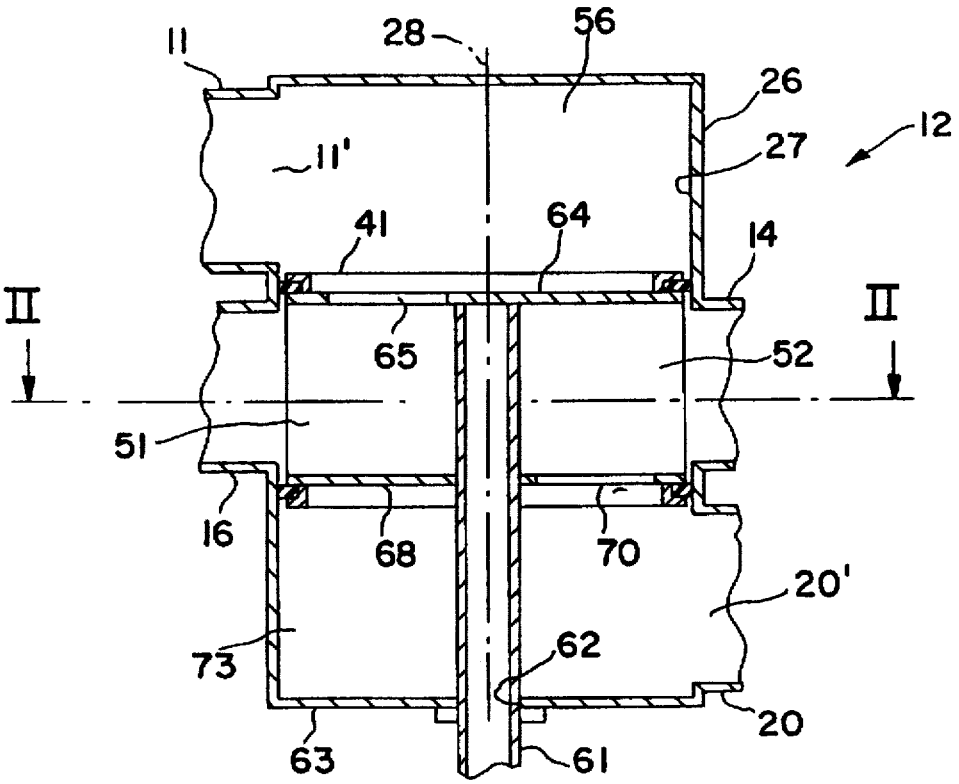
FIG. 3 is a section taken on the line III—III in FIG. 2.
Figure 6:
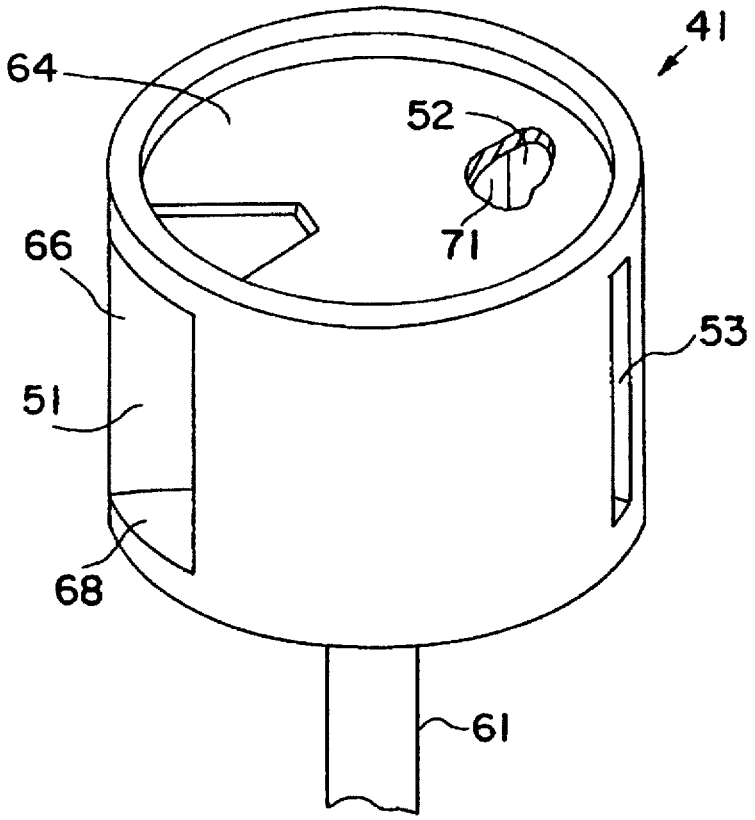
FIG. 6 is an isometric view of the valve rotor of FIGS. 2 and 3.

Referring to FIGS. 2, 3 and 6, the valve rotor 41 has a feed cavity 51, an exit cavity 52 and a purge cavity 53. The feed cavity 51 is always in feed gas receiving relation with a feed gas chamber 56 in the upper portion or end of the valve housing 26. The feed line 11 is connected to a feed port 11' in the valve housing 26 so as to be in free flow communication with the feed gas chamber 56. Thus the feed line 11 is always connected in impure gas delivery relation with the feed cavity 51 of the valve rotor 41. The exit line or conduit 20 is connected to an exit port 20' at the lower portion or end of the valve housing 26, thus placing the exit chamber 73 in constant free flow fluid communication with the exit blower 21. The valve rotor 41 includes a hollow cylindrical shaft 61 extending upward through an annular opening 62 in the bottom wall 63 of the valve housing 26. The hollow shaft is connected by a rotary connector, not shown, to the purge line 23 and serves as a purge port in the valve housing. The hollow shaft 61 is in coaxial relation with the cylindrical valve housing 26 and at its top end it is welded to a disc shaped horizontal top wall 64 which has a pie shaped part removed to form an opening 65 so that the feed cavity 51 is always open to the feed chamber 56 in the upper portion or end of the valve housing 26. A pair of vertical walls 66, 67 are welded at their upper ends to the top wall 64 and at their lower ends to a disc shaped bottom wall 68. The exit cavity 52 of the valve rotor is defined by a pair of vertical walls 71, 72 welded at their upper ends to the top wall 64 and at their bottom ends to the bottom wall 68. The bottom wall 68 includes a pie shaped opening 70 which places the exit cavity 52 of the valve rotor 41 in free flow communication with an exit chamber 73 in the lower end or bottom portion of the valve housing 26. The radially inner ends of the vertical walls 66, 67, 71, 72 are welded to the hollow cylindrical shaft 61. The purge cavity 53 of the valve rotor is defined by a vertical wall 74 welded at its upper and lower ends to the top wall 64 and the bottom wall 68, respectively. The radially inner edge of the vertical wall 74 is welded to the hollow shaft 61. The purge cavity is further defined by a part of the vertical wall 72 and by a vertical wall segment 75 welded to walls 64, 68 and 72. The valve rotor 41 includes a cylindrically shaped wall 76 presenting a radially outer cylindrical surface. The cylindrically shaped wall 76 includes wall segments 77, 78, 79 between the radially outward openings of the feed, exit and purge cavities 51, 52, 53 of the valve rotor 41. Wall segment 77 extends between, and is welded to, the radially outer ends of vertical walls 66, 71. Wall segment 78 extends between, and is welded to, the radially outer ends of vertical walls 67, 74. Wall segment 79 is welded to the radially outer ends of vertical walls 72 and 75. Openings 81 in the tubular shaft 61 permit the flow of purified exhaust gas to the purge cavity 53 from whence it is blown through the radially outward opening of the purge cavity 53 to the bed conduit 18, when the rotor 41 is positioned as shown in FIG. 2. The purge cavity 53 is smaller than the feed and exit cavities since significantly less gas flows thru the purge circuit during operation of the incinerator. The radially outer cylindrical surface 42 of the rotor 41 between the feed cavity and the exit cavity is greater than the circumferential width of the widest of the bed ports 31, 32, 33. Thus during rotation of the rotor, feed gas is prevented from flowing to the exit cavity of the rotor. Since the circumferential widths of the openings of the feed cavity 51 and the exit cavity 52 are greater than the circumferential distance between the bed ports, the inflow of feed gas and the outflow of exit gas will be continuous at all times, including the time used to move the valve rotor from one operating position to another. In the embodiment of the invention shown in FIGS. 2, 3 and 6, the circumferential width of the feed and exit cavity openings is slightly less than one half the circumferential width of the bed ports.

During operation of the incinerator, the valve rotor 41 is rotated 120 degrees clockwise, as viewed in FIG. 2, at regular time intervals to three operating positions so as to sequentially connect each of the bed ports 31, 32 33 in turn to the feed cavity 51, the exit cavity 52 and the purge cavity 53. During rotation of the valve rotor 41 to switch the flow of feed gas from a first bed port to a second bed port, the feed cavity 51 will connect to the second bed port before it is disconnected from the first bed port, thus permitting uninterrupted flow of feed gas at all times. Likewise, the circumferential width of the opening of the exit port 52 is greater than the circumferential width of the circumferential distance between the bed ports, and this results in the exit cavity communicating with two bed ports during rotation of the rotor from one operating position to another, thus providing continuous exit flow of clean gas at all times.

Figure 4:
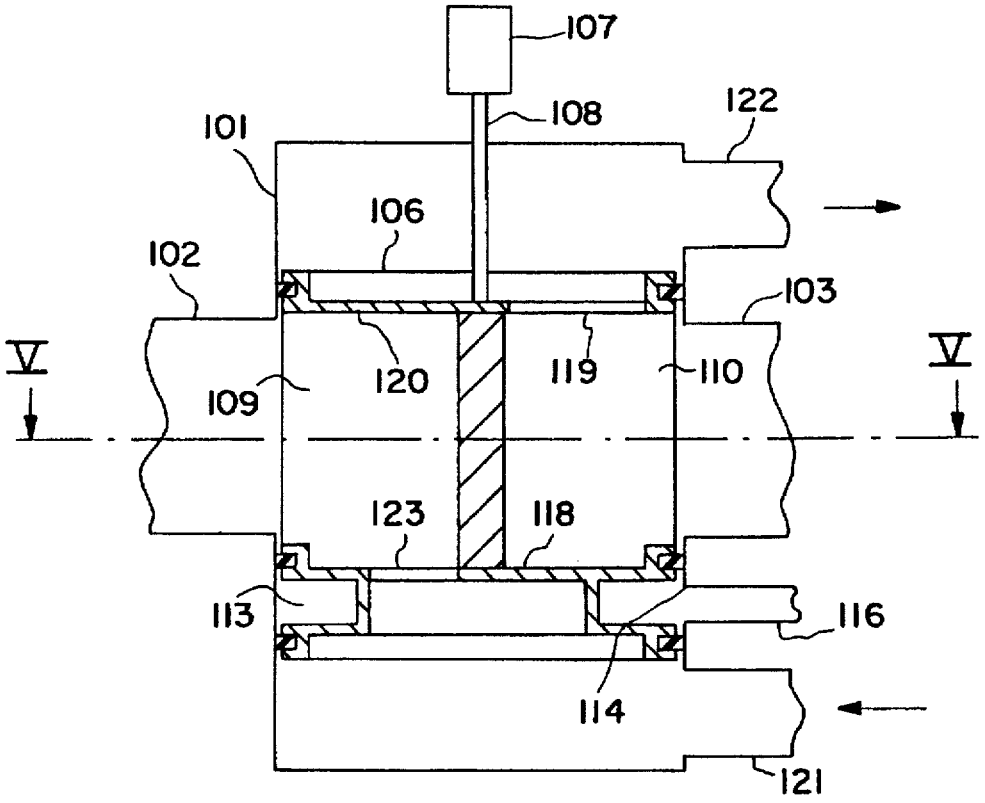
FIG. 4 is a section taken along the line IV—IV in FIG. 5 showing a second embodiment of the invention.
Figure 5:
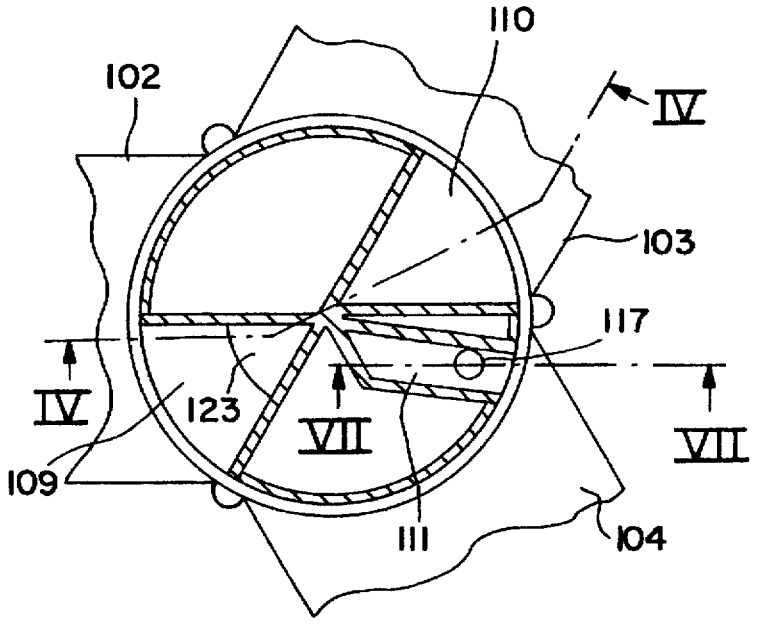
FIG. 5 is a section taken along the line V—V in FIG. 4.
Figure 7:
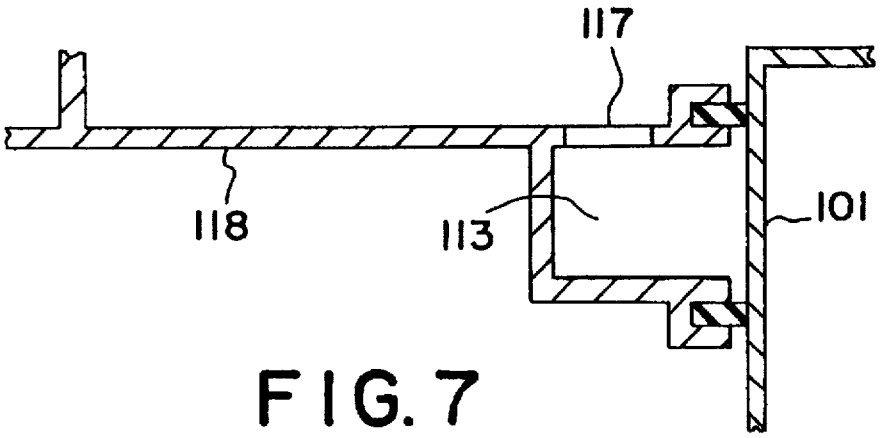
FIG. 7 is a section taken along the line VII—VII in FIG. 5.

Referring to FIGS. 4 and 5, an embodiment of this invention is illustrated in which a rotary valve for a regenerative fume incinerator includes a valve housing 101 to which bed conduits 102, 103, 104 are connected. A valve rotor 106 is rotated by power means in the form of an electric motor 107 connected in power transmitting relation to the valve rotor 106 by a vertical shaft 108. The spacing and dimensioning of a feed cavity 109, an exit cavity 110 and a purge cavity 111 and bed ports is similar to that illustrated in FIGS. 2 and 3; however, the feed gas enters at the bottom of the valve housing and clean gas exits from the top of the valve housing. The means for delivery of purge gas to the purge cavity is also different. Instead of delivery through a hollow rotor shaft, the purge gas is delivered to the purge cavity 111 by way of a radially outward open recess 113 formed circumferentially about the lower end of the rotor 106. The recess 113 is in constant registration with a purge port 114 in the valve housing 101 to which a purge line or conduit 116 is connected. As shown in FIGS. 5 and 7, an opening 117, in a bottom wall 118 of the rotor 106 connects the recess 113 with the purge cavity 111. The feed cavity 109 of the valve rotor 106 is connected to a lower subchamber of the valve housing 101 by an opening 123 in the bottom wall 118 of the rotor 106 and a feed conduit or pipe 121 is connected in feed gas delivery relation to a feed port in the valve housing 101 at a lower subchamber thereof. Exit gas is discharged through an exit gas line 122 connected to an exit port in an upper subchamber of the valve housing 101. The upper subchamber of the valve housing 106 is connected to the exit cavity 110 of the valve rotor 106 by an opening 119 in a top wall 120 of the valve rotor 106. This embodiment of the invention reduces the space required at the bottom of the valve shown in FIGS. 2 and 3 for the drive mechanism for the valve rotor, for the rotary seal between the hollow shaft and valve housing and for the rotary seal between the purge conduit and the rotary shaft. Also there is improved handling of any condensate in the feed gas.

Figure 8:
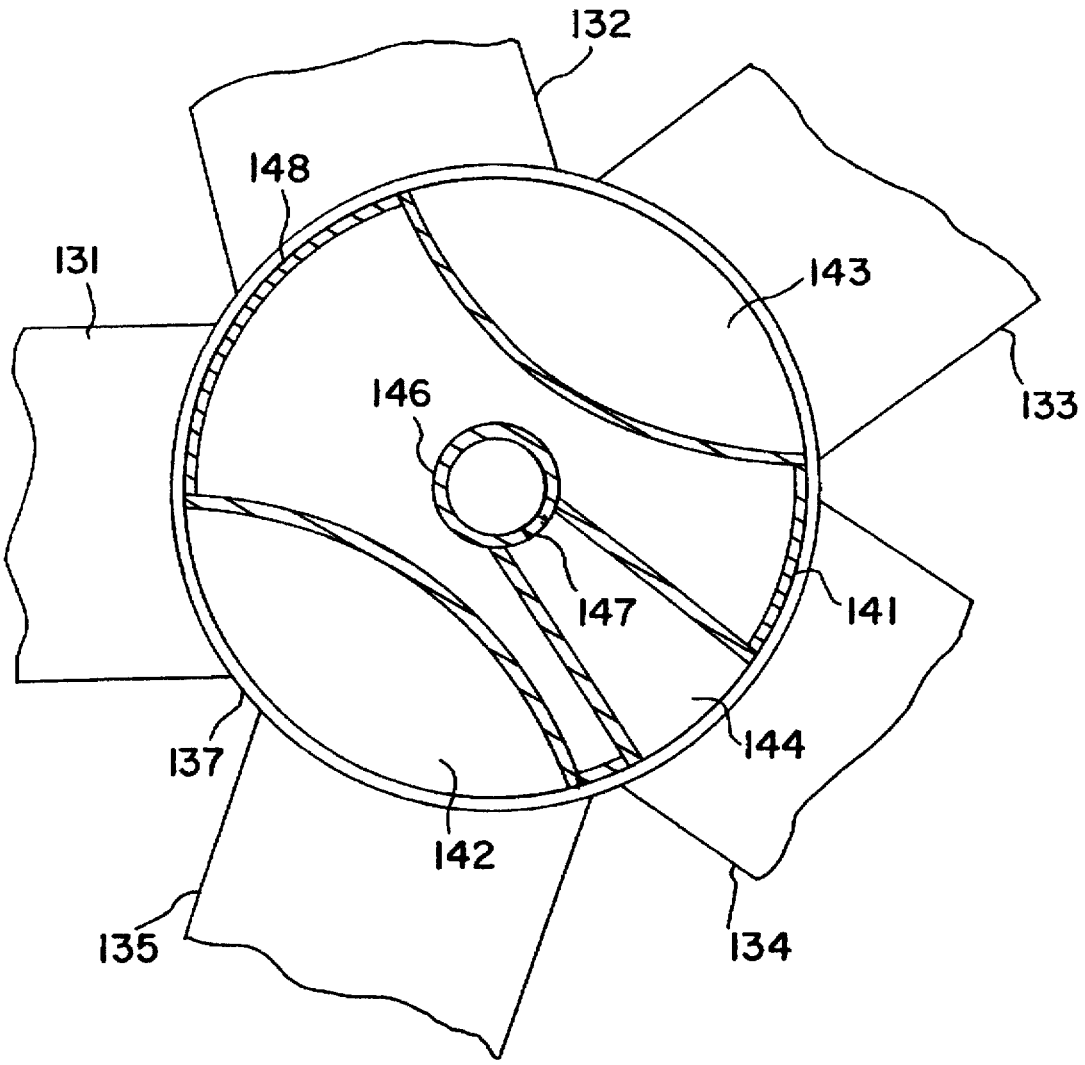
FIG. 8 is a section illustrating a rotary valve of this invention for a 5 bed regenerative fume incinerator system.

FIG. 8 illustrates a constant flow rotary valve for a 5 bed regenerative fume incinerator. Five bed conduits 131, 132, 133, 134, 135 are connected to five bed ports in the mid-portion of a valve housing 137. The valve rotor 141 includes a feed cavity 142, an exit cavity 143 and a purge cavity 144. The purge cavity is connected to a source of purge gas by way of a hollow rotor shaft 146 which has a discharge opening 147. The circumferential distance on the radially outer cylindrical surface 148 of the valve rotor 141 between the feed cavity 142 and the exit cavity 143 is greater than the circumferential width of the widest of the bed ports. Thus during clockwise rotation of the valve rotor from one operating position to another operating position, feed gas will not escape to the exit cavity by way of the bed port being connected to the feed gas. The circumferential width of the feed cavity and the exit cavity is greater than the sum of the circumferential width of a bed port and two spacings between bed ports, thus connecting 3 bed ports to feed and 3 bed ports to exit during portions of the rotation of the valve rotor from one operating position to another operating position. The top and bottom portions of the valve are similar to the valve illustrated in FIGS. 2 and 3.

Figure 9:
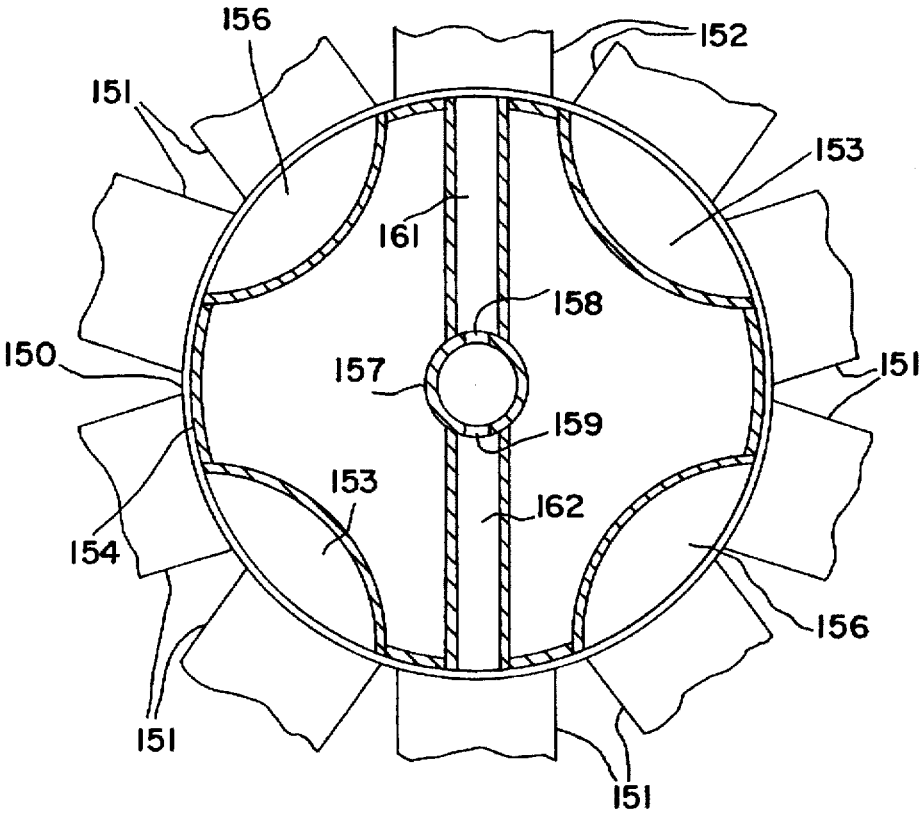
FIG. 9 is a section of a rotary valve of this invention for a 10 bed regenerative fume incinerator system.

FIG. 9 shows features of an adaptation of the invention to a ten bed regenerative fume incinerator. Ten bed ports of the valve housing 150 are connected to ten bed conduits 151 diagonally opposite feed cavities 153 in the valve rotor 154 connect 4 bed ports to feed gas while diagonally opposite exit cavities 156 connect 4 bed ports to the exit conduit, not shown. The hollow rotor shaft 157 serves to supply purge gas by way of openings 158, 159 in the shaft and purge cavities 161, 162. The circumferential distance on the cylindrical exterior surface of the valve rotor between adjacent feed and exit cavities is greater than the circumferential width of the widest bed port, thus preventing leakage of feed gas to an exit cavity by way of a bed port.

FIGS. 11, 12, 13 and 14 illustrate a preferred embodiment of the invention in the form of a constant flow rotary valve for a three bed regenerative fume incinerator. The valve housing 166 has a feed conduit 167 connected to its top portion 168 and an exit conduit 169 is connected to its bottom portion 170. Three rectangular shaped bed conduits 171, 172,173 are connected to three rectangular shaped bed ports 176, 177, 178 in the central portion of the cylindrical valve housing 166. A cylindrically shaped valve rotor 181 is positioned within the valve housing 166 for rotation about a vertical axis 182. The radially outward facing cylindrical surface of a cylindrical wall 183 of the rotor 181 is in confronting relation to the radially inward facing surface of the valve housing 166. Diametrically opposite feed and exit cavities 186 and 187 in the rotor 181 are formed by a pair of parallel vertical walls 188, 189, a horizontal top wall 191, a horizontal bottom wall 192 and a sloping wall 193. The feed and exit cavities 186, 187 have openings 194, 196 in the cylindrical wall 183 which are selectively registrable with the bed ports 176, 177, 178 upon rotation of the rotor 181 from one operating position to another. An opening 197 in the top wall 191 connects the feed cavity 186 of the rotor 181 in free flow fluid communication with the top portion 168 of the valve housing 166 to which feed gas is supplied via feed conduit 167. A pair of openings 198, 199 in the bottom wall 192 connect the bottom portion 170 of the valve housing 166 in constant free flow communication with the exit cavity 187. The valve rotor 181 includes a hollow shaft 201, for rotating the valve rotor and for delivering clean purge gas, which extends upwardly through a central opening in the bottom wall 192 and which has its upper end welded to the horizontal cross plate 202 extending between the vertical walls 188, 189. An opening 203 is provided in the cross plate 202 to allow purge gas to flow to an internal chamber 204 defined by the diagonal wall 193, the vertical walls 188, 189 the top wall 191, the cylindrical wall 183, the cross plate 202 and a sloping wall 206 extending between the vertical walls 188, 189 and between walls 183 and 202. An opening 207 in the vertical wall 189 allows free flow of purge gas to a purge cavity 208 defined by the top and bottom walls 191, 192, the vertical wall 189, the cylindrical wall 183 and a vertical wall 209 extending between the top and bottom walls 191, 192 and between the vertical wall 189 and the cylindrical wall 183. Completing the purge cavity 208, a purge cavity opening 211 is formed in the cylindrical wall 183 of the rotor 181 which selectively registers with the bed ports 176, 177, 178 of the valve housing 166 when the rotor 181 is rotated to it operating positions.

In the embodiment of the invention illustrated in FIGS. 11–14, each of the bed ports extends about 115 degrees about the circumference of the valve housing 166 and each of the lands between the bed ports extend about 5 degrees about the circumference of the valve housing 166. In order to insure that a bed port will be blocked by the radially outward facing cylindrical surface of the cylindrical wall of the rotor 181, the cylindrical surface of the rotor 181 between the feed cavity opening 194 and the exit cavity opening 196 extends more than 115 degrees about the rotor 181 and as illustrated, extends about 125 degrees about the circumference of the rotor. The feed and exit openings 194, 196 each extend circumferentially about 55 degrees about the circumference of the rotor 181. As the valve rotor 181 is rotated clockwise from its operating position illustrated in FIG. 12, the feed cavity 188 will deliver feed gas to the bed conduit 172 through bed port 177 before delivery of feed gas from the feed cavity 188 to bed conduit 171 is interrupted. Thus a constant, uninterrupted flow of feed gas is insured by this valve design. Likewise the exit cavity 187 will bridge the housing land between the adjacent bed ports 177 and 178 as the rotor 181 is rotated clockwise, thus insuring constant, uninterrupted flow of exit gas at all times.

Figure 15:
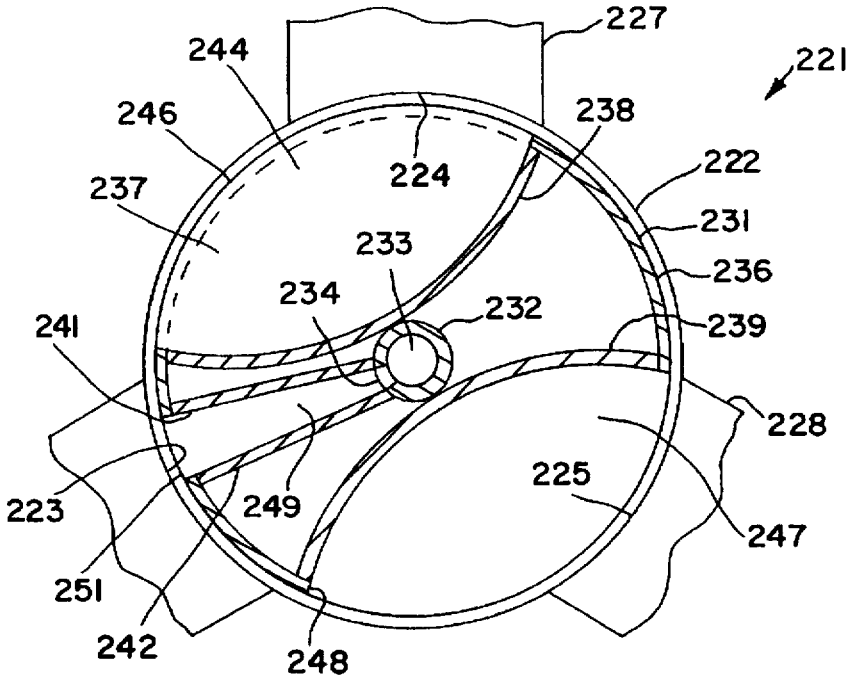
FIG. 15 is a section showing of a valve rotor for a 3 bed regenerative fume incinerator incorporating another embodiment of this invention and FIG. 16 is a section showing of a valve rotor for a 5 bed regenerative fume incinerator incorporating a further embodiment of this invention.
Figure 16:
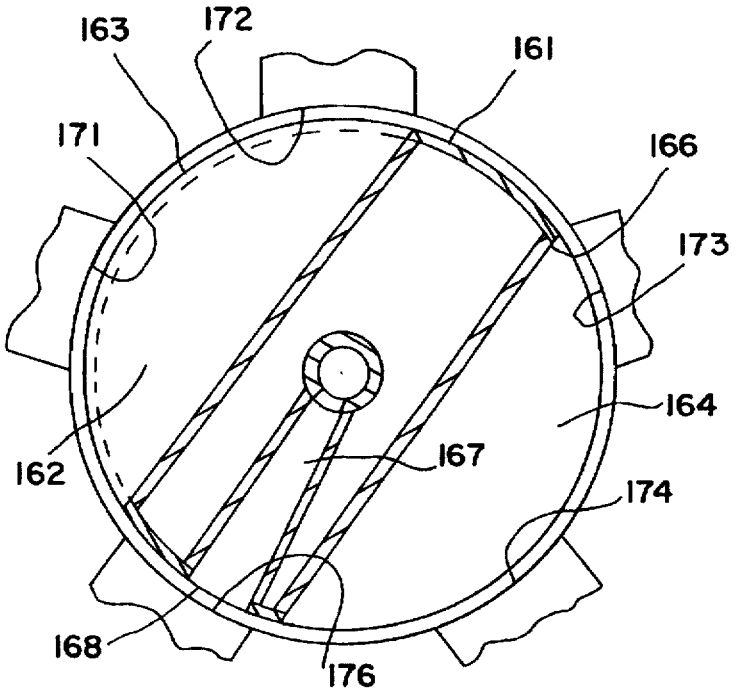

The constant flow rotary valves illustrated in FIGS. 15 and 16 are believed to have application in regenerative fume incinerator systems where smaller external conduits are desired. Instead of the bed ports occupying almost all the circumferential space about the valve housing as shown in the other embodiments of the invention, the total circumferential space occupied by the bed ports of the embodiments of FIGS. 15 and 16 is less than one half the circumference. As shown in FIG. 15, a 3 bed constant flow rotary valve 221 includes a valve housing 222 with bed ports 223, 224, 225 to which bed conduits 226, 227, 228 are connected. The circumferential distance between the bed ports is greater than the circumferential width of the bed ports. A valve rotor 231 is provided which has a hollow shaft 232 for rotating the rotor about a vertical axis 233 and for delivery of clean purge gas by way of an opening 234 in the hollow shaft. The rotor 231 includes a cylindrical wall 236, a horizontal top wall, not shown, a horizontal bottom wall 237, a pair of curved walls 238, 239 having their upper and lower ends connected to the upper and lower walls, respectively, and a pair of straight vertical walls 241, 242 also extending vertically between the top and bottom walls. The walls define a feed cavity 244 having an opening 246, an exit cavity 247 having an opening 248 and a purge cavity 249 having an opening 251. The circumferential width of the feed and exit openings 246, 248 is greater than the circumferential distance between the bed ports, thus insuring constant flow of feed gas and exit gas through the valve. The outward facing cylindrical surface of the valve rotor between the feed opening 246 and the exit opening 248 is greater than the circumferential width of the largest of the bed ports, thus insuring that feed gas will not flow to the exit cavity during rotation of the valve.

The constant flow rotary valve of FIG. 16 includes a valve rotor 161 which is constructed in a manner similar to rotor of FIG. 15 and includes a feed cavity 162 with a feed opening 163, an exit cavity 164 with an exit opening 166 and a purge cavity 167 with a purge opening 168. The feed and exit openings 163, 166 extend circumferentially a sufficient distance so that 3 of the 5 bed ports 171, 172, 173, 174, 176 are exposed to each of these openings during rotation of the valve rotor 161. In other words, as the valve rotor 161 is rotated clockwise from its illustrated operating position, in which bed ports 171 and 172 are supplied feed gas, to the next operating position, in which bed ports 172 and 173 will be supplied feed gas, the feed cavity opening 163, at an intermediate position, will supply feed gas to bed ports 171, 172 and 173. In a similar manner the exit cavity opening will receive exit gas from three bed ports at an intermediate part of the rotative movement of the valve rotor 161 from one operating position to another operating position. From a dimensioning standpoint, the circumferential width of the openings of the feed and exit cavities is wider than the sum of the width of a bed port and two times the circumferential space between the bed ports.

The embodiments of FIGS. 2 and 15 are similar in that:

1. The feed cavity has a circumferential width permitting it to connect to only one bed port when the valve rotor is at rest in an operating position but is wide enough to connect to two bed ports simultaneously as the valve rotor is rotated from one operating position to another operating position.

2. The exit cavity has a circumferential width permitting it to connect to only one bed port when the valve rotor is at rest in an operating position but is wide enough to connect to two bed ports simultaneously as the valve rotor is rotated from one operating position to another operating position.

3. The valve rotor has a pair of diametrically opposite and radially outward facing surfaces between the feed cavity and the exit cavity which are circumferentially at least as wide as a bed port and 4. A purge cavity is formed in one of the radially outward facing surfaces of the valve rotor which connects to one bed port when the feed cavity connects to a second bed port and the exit cavity connects to a third bed port.

In addition to the valve of this invention providing the advantage of having uninterrupted flows of feed gas and exit gas, there is very little fluctuation in the flows, thus providing excellent "flow through" efficiency for the incinerator. By avoiding the stoppage of flow during cycling of the beds of the incinerator, the attendant disruptive flow surges, which can have a damaging effect on equipment, are avoided.

What is claimed is:

1. A continuous flow rotary valve for a regenerative fluid purification system, comprising:

a valve housing having upper and lower ends and an interior chamber with an annular interior surface defined by rotation of a line about a vertical axis, said chamber including three substantially equal size bed ports spaced circumferentially at equal intervals about said interior surface with substantially equal circumferential spacing between said bed ports a feed port at one of said upper and lower ends of said valve housing, an exit port at the other of said upper and lower ends of said valve housing, a purge port in said valve housing spaced from said feed and exit ports, a valve rotor rotatably supported in said valve housing for rotation in a predetermined direction about said vertical axis between predetermined operating positions and having an annular wall with a radially outer annular surface in confronting relation to said interior surface of said valve housing and wall means in said valve rotor defining separate feed, exit and purge cavities in free flow communication with said feed, exit and purge ports, respectively, each of said cavities having an opening in said radially outer annular surface which sequentially registers with said bed ports upon said valve rotor being rotated in said predetermined direction to its said operating positions, said opening of said exit cavity being spaced circumferentially from said opening of said feed cavity a distance greater than the circumferential width of the widest bed port, said openings of said feed and exit cavities having a circumferential width substantially greater than said circumferential spacing between said bed ports, in each operating position said feed, exit and purge cavities each register individually with a different one of said bed ports.

2. The rotary valve of claim 1 wherein said openings of said bed ports are spaced circumferentially from one another not more than 12 degrees about the circumference of said annular interior surface of said valve housing.

3. The rotary valve of claim 1 wherein said annular interior surface is cylindrical.

4. The rotary valve of claim 1 wherein said feed and exit cavity openings have a circumferential width which is greater than the sum of the circumferential width of a bed port and the circumferential distance between bed ports.

5. The rotary valve of claim 1 wherein said valve rotor includes a radially outward opening annular recess in constant free flow fluid communication with said purge port and wherein said recess is connected to said purge cavity of said rotor.

6. The rotary valve of claim 1 wherein said rotor includes a hollow shaft extending through said valve housing which serves as said purge port and wherein said hollow shaft is connected in free flow fluid communication with said purge cavity.

7. The rotary valve of claim 1 wherein said annular wall is cylindrical, wherein said feed and exit cavity openings have a rectangular shape and have a pair of substantially vertical edges and wherein said wall means includes top and bottom walls, a pair of substantially parallel vertical walls extending between said vertical edges of said feed and exit cavity openings, a sloping divider wall extending from the bottom of said feed cavity opening to the top of said exit cavity opening, an opening in said top wall placing said feed cavity in free flow fluid communication with said upper end of said housing and at least one opening in said bottom wall placing said exit port in free flow fluid communication with said bottom end of said valve housing.

8. The rotary valve of claim 7 wherein said valve rotor includes a hollow shaft connected in free flow fluid communication with said purge cavity.

9. The rotary valve of claim 7 wherein said annular wall is cylindrical and said purge cavity is defined in part by a vertically extending partition wall extending from one of said vertical walls to said cylindrical wall.

10. The rotary valve of claim 1 and further comprising a fluid seal in each of the portions of said valve housing constituting said circumferential spaces between said bed ports.

11. The rotary valve of claim 10 wherein each of said fluid seals is connected to a source of purge gas.

12. The rotary valve of claim 11 wherein said fluid seal includes a pair of circumferentially spaced wiper blades and wherein said purge gas is delivered to the space between said blades.

13. The rotary valve of claim 1 wherein said valve housing includes 5 bed ports and wherein each of said openings of said feed and exit cavities is circumferentially wider than the sum of the circumferential width of a bed port and two times the circumferential space between bed ports, whereby during a portion of the rotation of said valve rotor from one operating position to another operating position said exit cavity will receive exit gas from 3 of said bed ports and during another portion of the rotation of said valve rotor from one operating position to another operating position said feed cavity will supply feed gas to 3 bed ports.

14. A rotary valve operable in gas purification system having three beds, a source of impure feed gas, an exit for purified gas and a purge gas, comprising:

a valve housing having an upper section, a lower section, a middle section and an interior chamber with a cylindrical interior surface defined by rotation of a line about a vertical axis, a feed port in one of said upper and lower sections of said valve housing, an exit port in the other of said upper and lower sections of said valve housing, three bed ports in said middle section of said valve housing, said ports being equally spaced circumferentially around said middle section providing a spacing distance between said ports equal to not more than 12 percent of the circumferential width of said ports, said spacing distance between said ports being pressurized with said purge gas to provide a flow of pure gas into the annulus between the inside of said valve body and the outside of said rotor, a valve rotor rotatably supported in said valve housing and having a cylindrically shaped exterior surface in close proximity to said interior surface in said middle zone, wall means in said valve rotor defining separate feed, exit and purge cavities, said feed cavity including an opening in said exterior surface registerable individually with said bed ports upon rotation of said rotor, said feed cavity being in constant fluid communication with said feed port and the circumferential width of said opening of said feed cavity extending less than 60 degrees about said exterior surface of said rotor, said exit cavity having an opening in said exterior surface registrable individually with said bed ports upon rotation of said rotor, said opening of said exit cavity having a circumferential width extending less than 60 degrees about said exterior surface and being circumferentially spaced from said opening of said feed cavity approximately 180 degrees, said purge cavity having an opening in said exterior surface registrable individually with said bed ports upon rotation of said rotor, said opening of said purge cavity being of a circumferential width extending less than 60 degrees about said exterior surface and being disposed between said openings of said feed and exit cavities, a rotor shaft opening in one of said upper and lower sections of said valve housing concentric with said cylindrical surface of said valve housing, a hollow rotor shaft disposed in said shaft opening and non-rotatably connecting to said valve rotor, said hollow shaft being connected in free flow fluid communication with said purge cavity and being connectable to said purge gas and means operable to rotate said valve rotor at predetermined times to operating positions whereby said bed ports are sequentially placed in registration with said feed cavity, said purge cavity and said exit cavity, said exterior surface of said rotor between said feed and exit cavity openings extending circumferentially a sufficient distance to cover each of said bed ports as said valve rotor is rotated, thereby preventing flow of feed gas to said exit cavity during rotation of said valve rotor from one operating position to another, said feed cavity bridging adjacent bed ports during rotation of said valve rotor from one operating position to another operating position whereby the feed gas is free to flow through said valve at all times, said exit cavity bridging adjacent bed ports during rotation of said valve rotor from one operating position to another operating position whereby the exit gas is free to flow through said valve at all times.

15. In a regenerative fume incinerator of the type having three regenerator beds at least partially filled with refractory material and having upper and lower ends with the upper ends being connected in common to a combustion chamber, the combination comprising:

a feed gas line, an exit gas line, a continuous flow rotary valve including a valve housing having upper and lower ends and an interior chamber with an annular interior surface defined by rotation of a line about a vertical axis, said chamber including three substantially equal size bed ports spaced circumferentially at equal intervals about said interior surface with substantially equal circumferential spacing between said bed posts, a feed port at one of said upper and lower ends of said valve housing, said feed port being connected to said feed gas line, an exit port at the other of said upper and lower ends of said valve housing, said exit port being connected to said exit line and a purge port in said housing disposed in spaced relation to said feed and exit ports, three bed lines connecting said three bed ports with said lower ends of said three regenerator beds, respectively, a valve rotor rotatably supported in said valve housing for rotation in a predetermined direction about said vertical axis between predetermined operating positions, said valve rotor having an annular wall with a radially outer annular surface in confronting relation to said interior surface of said valve housing and wall means in said valve rotor defining separate feed, exit and purge cavities in free flow communication with said feed, exit and purge ports, respectively, each of said cavities having an opening in said radially outer annular surface which sequentially registers with said bed ports upon rotation of said valve rotor in said predetermined direction to said operating positions, said opening of said exit cavity being spaced circumferentially from said opening of said feed cavity a distance greater than the circumferential width of the widest one of said bed ports, said openings of said feed and exit cavities having a circumferential width substantially greater than said circumferential spacing between said bed ports, in each of said operating positions said feed, exit and purge cavities each register individually with a different one of said bed ports, a blower in one of said feed gas and exit lines operable to induce flow of gas through said incinerator and a purge line interconnecting said purge port with one of said exit and feed gas lines.

16. The incinerator of claim 15 and further comprising:

fluid seals in said valve housing between said bed ports and conduit means interconnecting said fluid seals with said purge line.

* * * * *